US006605771B1

(12) United States Patent
Baggs

(10) Patent No.: US 6,605,771 B1
(45) Date of Patent: Aug. 12, 2003

(54) PICKUP ASSEMBLY FOR MUSICAL INSTRUMENT

(76) Inventor: Lloyd R. Baggs, 210 El Cerrito Dr., Nipomo, CA (US) 93444

( * ) Notice: Subject to any disclaimer, the term of this patent is extended or adjusted under 35 U.S.C. 154(b) by 0 days.

(21) Appl. No.: 09/816,505

(22) Filed: Mar. 23, 2001

(51) Int. Cl.[7] ..... G10H 3/14; G10H 3/18
(52) U.S. Cl. ..... 84/731; 84/723; 84/730
(58) Field of Search ..... 84/723–734

(56) References Cited

U.S. PATENT DOCUMENTS

| | | | | | |
|---|---|---|---|---|---|
| 3,301,936 | A | | 1/1967 | Carmen et al. | 84/1.16 |
| 3,453,920 | A | | 7/1969 | Scherer | 84/1.16 |
| 3,624,264 | A | | 11/1971 | Lazarus | 84/1.14 |
| 4,030,396 | A | | 6/1977 | Mariner | 84/1.16 |
| 4,269,103 | A | * | 5/1981 | Underwood | 84/726 |
| 4,364,295 | A | | 12/1982 | Stich | 84/1.15 |
| 4,491,051 | A | | 1/1985 | Barcus | 84/1.16 |
| 4,567,805 | A | | 2/1986 | Clevinger | 84/1.16 |
| 4,657,114 | A | * | 4/1987 | Shaw | 84/731 |
| 4,688,460 | A | | 8/1987 | McCoy | 84/1.16 |
| 4,860,625 | A | | 8/1989 | Mathews | 84/1.16 |
| 4,882,965 | A | | 11/1989 | McClish | 84/1.16 |
| 4,911,054 | A | | 3/1990 | McClish | 84/725 |
| 4,916,350 | A | | 4/1990 | Madden et al. | 310/338 |
| 5,109,747 | A | * | 5/1992 | Spuler | 84/731 |
| 5,206,449 | A | | 4/1993 | McClish | 84/723 |
| 5,237,126 | A | | 8/1993 | Curtis et al. | 84/724 |
| 5,461,193 | A | * | 10/1995 | Schertler | 84/727 |
| 5,552,562 | A | | 9/1996 | Hertz et al. | 84/726 |
| 5,817,966 | A | * | 10/1998 | Fishman | 84/731 |
| 5,866,835 | A | | 2/1999 | Baggs | 84/731 |
| 5,932,827 | A | * | 8/1999 | Osborne et al. | 84/726 |
| 5,990,408 | A | | 11/1999 | Hasebe | 84/723 |
| 6,023,019 | A | | 2/2000 | Baggs | 84/731 |
| 6,326,539 | B1 | * | 12/2001 | Mishima | 84/723 |

FOREIGN PATENT DOCUMENTS

| | | |
|---|---|---|
| GB | 2070313 | 9/1981 |
| WO | WO 86/07484 | 12/1986 |

OTHER PUBLICATIONS

Dao, T., Letter Regarding Experimental Use, 2 pages.

* cited by examiner

*Primary Examiner*—Marlon T. Fletcher
(74) *Attorney, Agent, or Firm*—Christie, Parker & Hale, LLP

(57) ABSTRACT

A pickup assembly for a stringed instrument comprises an elongated beam with slits that create gaps within the beam. Sensors are positioned over the slits and measure changes in dimensions of the gaps. The sensors produce an electrical signal in response to the change in dimensions of the gaps and the electrical signal is then sent to a pre-amplifier and thence to a speaker system for sound reproduction.

90 Claims, 8 Drawing Sheets

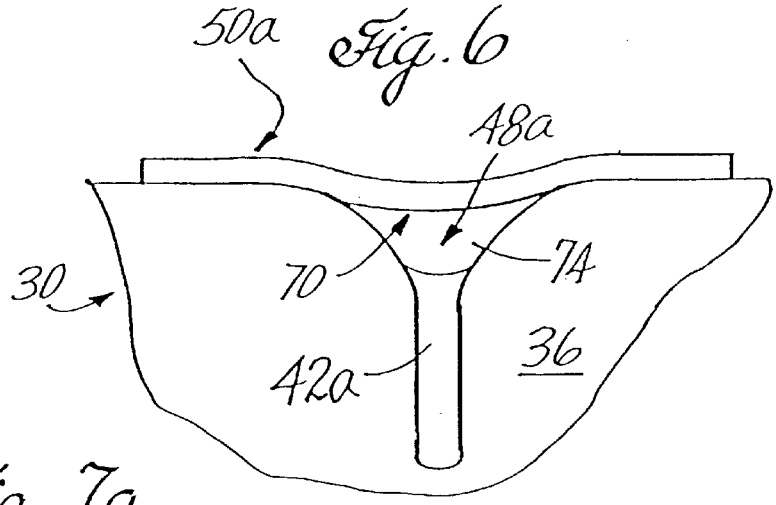
Fig. 6
Fig. 7a
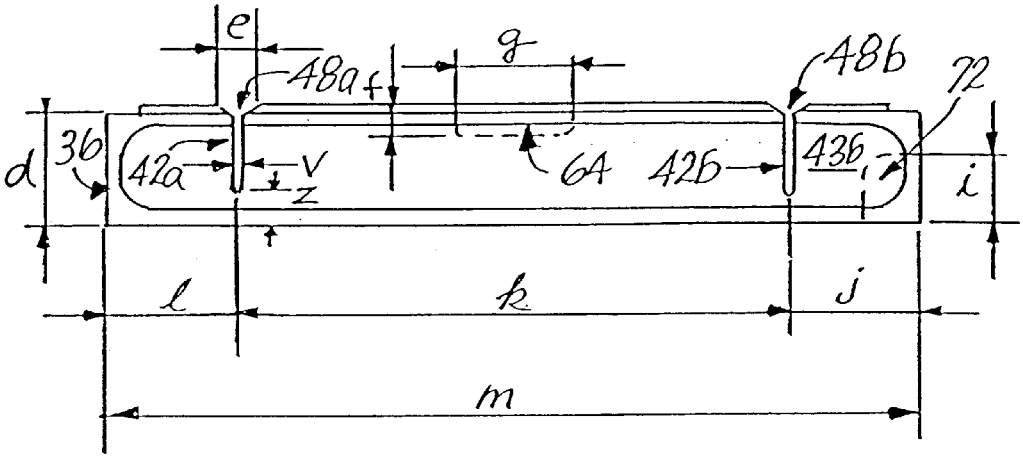
Fig. 7b
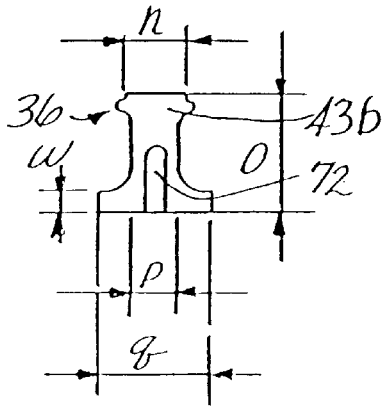

76
92
92
88
88
90
86
82
92
91
80
78
84

PICKUP ASSEMBLY FOR MUSICAL INSTRUMENT

FIELD OF THE INVENTION

The present invention relates generally to pickup assemblies, i.e., transducers, for musical instruments. The present invention relates more particularly to a pickup assembly for stringed instruments, wherein the pickup assembly senses vibration mainly in the X-axis direction but is substantially insensitive to vibrations in the Y-axis direction.

BACKGROUND OF THE INVENTION

Pickups for stringed musical instruments are well known. One common example of such a pickup assembly is the transducer of an electric guitar, which converts movement, i.e., vibration, of the guitar strings into electrical signals which may be amplified and/or otherwise modified so as to provide the desired volume and/or sound effects. Pickups allow relatively quiet instruments to be heard when played with other louder instruments, or when played to large audiences.

Previous pickup assemblies have included body pickups, string pickups and three axis accelerometer pickups. The body pickup assembly is attached directly to the top of the guitar, often behind the bridge, and can be typically formed from a piezoelectric sensor material such as piezoelectric crystal or film. Because each guitar is unique, it is difficult to determine the optimal location to mount the pickup on a guitar body to obtain the highest quality sound. Finding the optimal pickup mounting location which will result in the highest sound quality can require numerous hours and often days of experimentation with each guitar. Also, due to the large distance from the body pickup to the instrument strings, feedback is a problem. The feedback problem precludes stringed instruments which incorporate body pickups from being played very loudly.

String pickups, including undersaddle pickups, eliminate or reduce the feedback problem, but do not provide optimum levels of sound quality. String pickups primarily detect vibrations from the strings and not the guitar body and as a result, the full sound quality of the guitar is not reproduced.

Three axis accelerometer pickups, which detect motion in the X, Y and Z axes directions, provide a relatively good sound quality but are not consistently dependable. Such pickups are mounted on a small box-shaped enclosure that is placed preferably inside the guitar under the saddle on the bridge plate. These pickups are very difficult to optimally place on the guitar because the microdynamics of the bridge plate are so different from guitar to guitar.

It is desired to provide to the art a pickup for stringed instruments which detects vibrations mainly transverse the string direction (the X-axis direction), combines the sound of both the guitar body and the strings, and is easy to place to obtain optimum sound quality.

SUMMARY OF THE INVENTION

The present invention is directed to a pickup assembly for a stringed musical instrument. The pickup assembly comprises an elongated beam having first and second ends with at least one slit through the top surface thereof. The slit, which is at an angle that is generally perpendicular to the axis along the length of the beam, has at least one sensor extending there-across. The sensor produces an electrical signal in response to a change in dimension of the gap that defines the slit where the gap dimension changes in response to vibrations from the instrument. At least one contact pad is in electrical contact with the sensor and transmits the electrical signal from the sensor to a wire for transmissions to a pre-amplifier.

It is understood that changes in the specific structure shown and described herein may be made within the scope of the claims without departing from the spirit of the invention.

BRIEF DESCRIPTION OF THE DRAWINGS

These and other features, aspects and advantages of the present invention will be more fully understood when considered with respect to the following detailed description, appended claims and accompanying drawings, wherein:

FIG. 6 is a semi-schematic fragmentary side view of a slit in the beam portion of the pickup assembly of FIG. 3;

FIG. 7*a* is a semi-schematic side view of the beam portion of one exemplary embodiment of a pickup assembly provided in accordance with the present invention showing dimensions;

FIG. 7*b* is a semi-schematic end view of the beam of FIG. 7*a* showing dimensions;

DETAILED DESCRIPTION OF THE INVENTION

Figure 1:
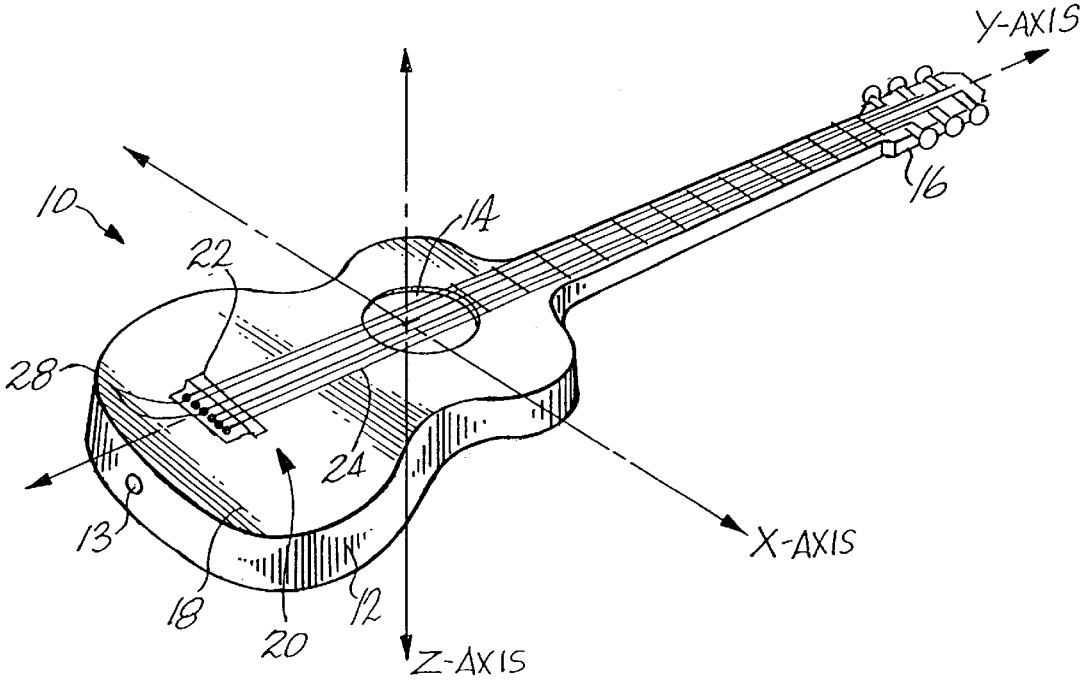
FIG. 1 is a perspective view of a guitar useful for mounting a pickup assembly provided in accordance with practice of the present invention.
Figure 2:
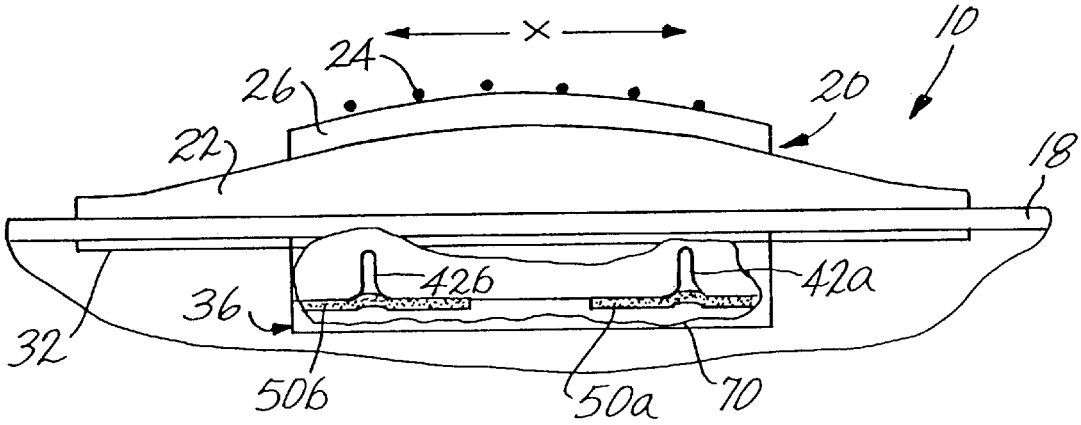
FIG. 2 is a semi-schematic fragmentary side view of one exemplary embodiment of a pickup assembly provided in accordance with practice of the present invention mounted in the bridge plate of a guitar.

Turning to FIGS. 1 and 2, a guitar 10 is shown which is useful for mounting either a prior art pickup assembly or a pickup assembly provided in accordance with practice of the present invention. The guitar 10 comprises a body 12, a soundhole 14 and a peg head 16. A sound board 18, which defines the top surface of the guitar body 12, has a bridge assembly 20 mounted thereon. The bridge assembly 20 includes a bridge 22 which provides for the support and attachment of one end of the strings 24 according to well known principles. Turning particularly to FIG. 2, the bridge 22 includes a saddle 26 which is mounted in a slot (not shown) in the bridge. The strings 24 extend from string retaining posts 28 (shown in FIG. 1) which are anchored to the bridge assembly 20. The strings 24 extend across the saddle 26 to where they are mounted on the peg head 16. The X, Y and Z axes directions of the guitar 10 are labeled in FIG. 1.

Figure 3:
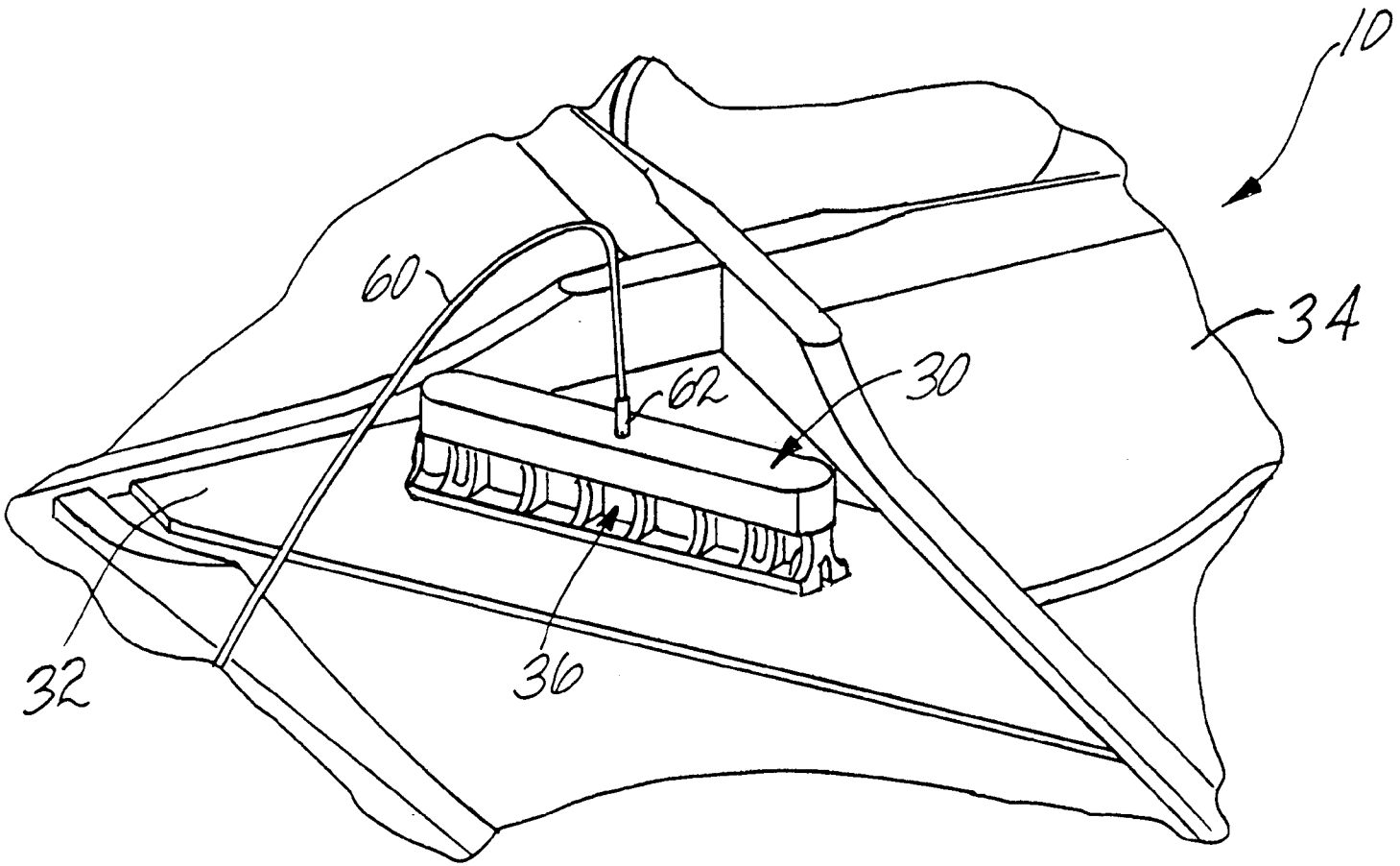
FIG. 3 is a semi-schematic fragmentary perspective view of the pickup assembly of FIG. 2.
Figure 4:
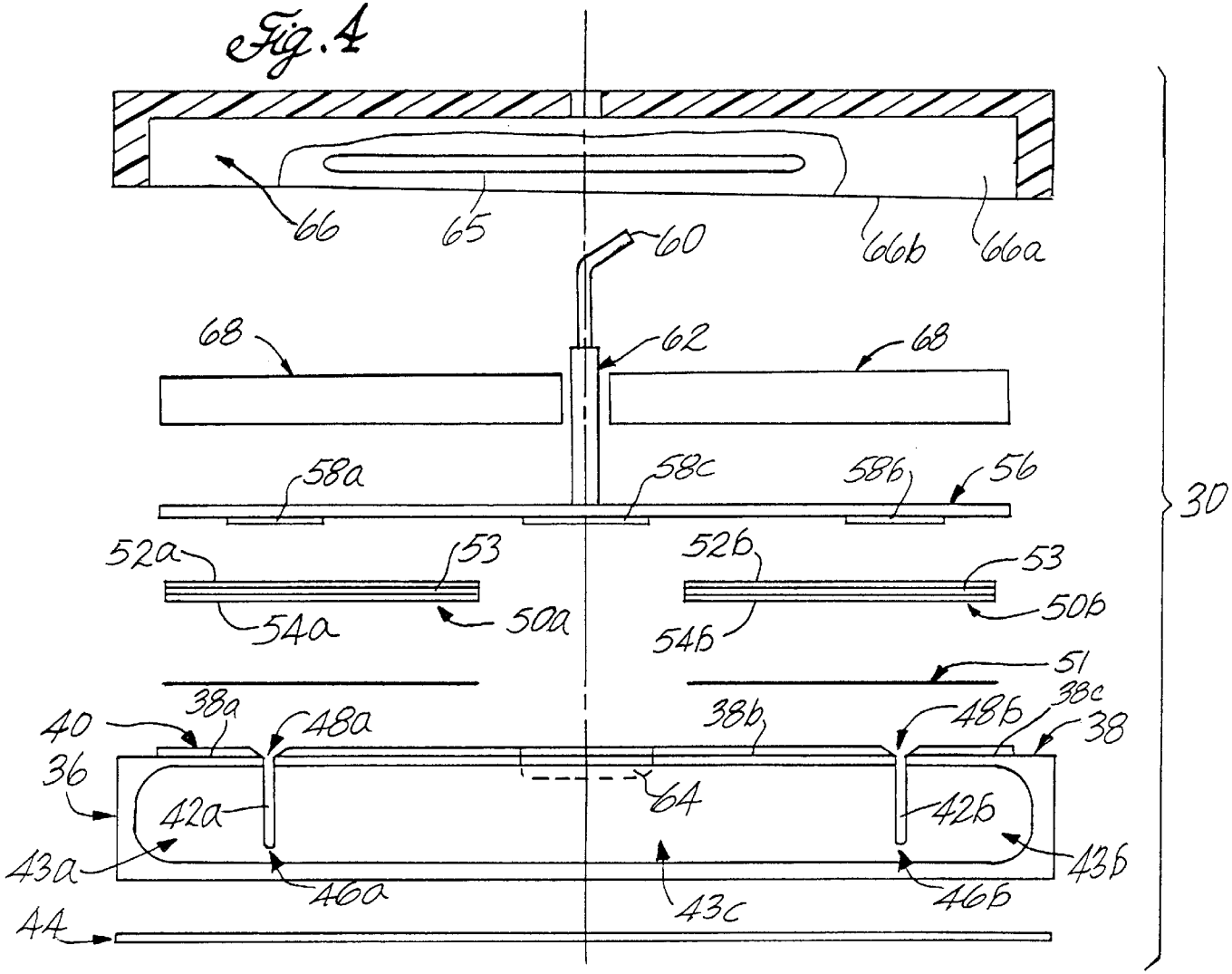
FIG. 4 is a semi-schematic exploded side view in partial cross section of the components of the pickup assembly of FIG. 3.

Referring now to FIG. 3, one embodiment of a pickup assembly 30, provided in accordance with practice of the present invention is shown. The pickup assembly is mounted on a bridge plate 32, located on the inside surface of the sound board 18, of the guitar which, in turn, is mounted on the inside surface of the guitar sound board 34 beneath the bridge assembly. In an alternative embodiment, the pickup assembly can be directly mounted to the inside or outside surface of the sound board 18. Referring to FIG. 4 in addition to FIG. 3, the pickup assembly 30 comprises an elongated beam 36 having an surface 38 comprised of three separate portions, the left portion 38*a*, the center portion 38*b* and the right portion 38*c*, as well as a ledge 40 disposed thereon. In the illustrated embodiment, the length of the ledge is less then the length of the top surface of the beam and is equidistant from either end of the beam.

In a preferred embodiment, the beam 36 is made of an acrylonitrile-butadiene styrene (ABS) plastic material with 2.5% carbon and 10% stainless steel fibers incorporated therein to provide conductivity. If desired, however, the beam 36 can be made from other suitable plastic materials, or from wood, such as spruce and maple or from a metal, such as aluminum or zinc.

If the material used for the beam 36 is electrically non-conductive, the top surface of the beam, including the ledge 40, is coated with a conductive material to thereby provide a ground plane for the pickup assembly and a shield against RF interference.

Referring particularly to FIG. 4, slits 42*a* and 42*b* are formed through the top surface of the beam 36 and extend through a portion of the height of the beam at an angle generally perpendicular to the axis along the length of the beam (the X-axis) to thereby create gaps within the beam. The portions of the beam which remain between the bottom of the slits and the bottom surface of the beam define living hinges 46*a* and 46*b* which allow the ends 43*a* and 43*b* of the beam to move relative to the beam center portion 43*c*. The top portion of each slit 42*a* and 42*b* extends through the ledge 40 and defines V-shaped sections 48*a* and 48*b* respectively.

Figure 5:
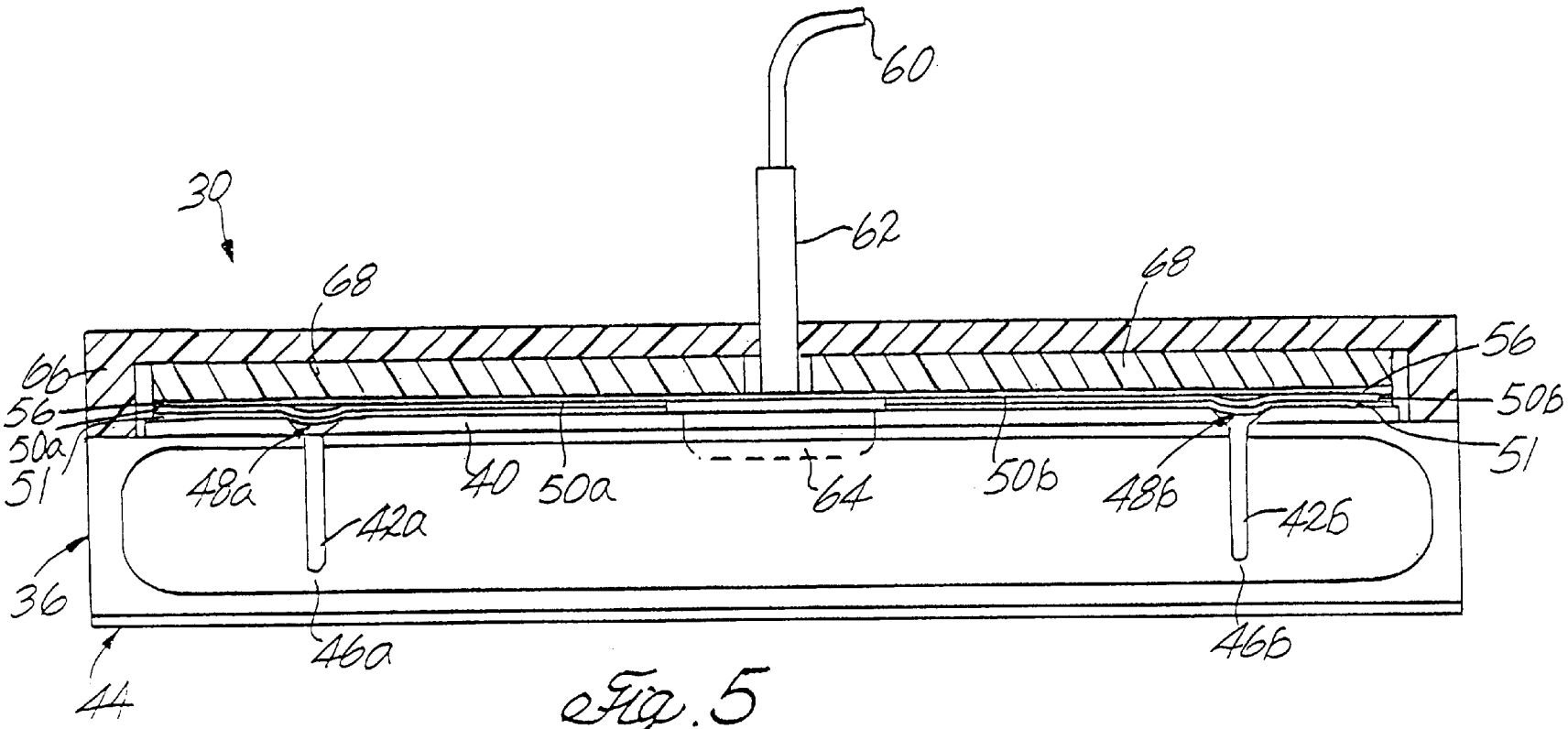
FIG. 5 is a semi-schematic side view in partial cross section of the pickup assembly of FIG. 3 shown in its assembled condition.

Turning to FIG. 5 in addition to FIG. 4, a first sensor 50*a* is positioned across the first slit 42*a* and a second sensor 50*b* is positioned across the second slit 42*b*. In a preferred embodiment, the sensors 50*a* and 50*b* are attached to the beam surface with an electrically conductive adhesive 51. Adhesives such as those identified with the number 9703 manufactured by Scotchbrand of 3M Corporation of St. Paul, Minn. can be used. In an alternative embodiment, the sensors 50*a* and 50*b* are capacitively coupled to the beam surface by using a nonconductive dielectric adhesive. By placing the dielectric adhesive between two conductive elements, the negative electrodes 54*a* and 54*b* of the sensors and the conductive surface of the beam, a capacitance is created that couples the sensors to the beam surface. Adhesives such as Hysol epoxy manufactured by Dexter-Hysol Corp. of Industry, Calif. can be used.

Referring particularly to FIG. 4, in a preferred embodiment, the sensors 50*a* and 50*b* are made from a polyvinylidine fluoride (PVDF) film 53 with positive electrodes 52*a* and 52*b*, made from nickel, respectively vapor deposited on one surface of each sensor and negative electrodes 54*a* and 54*b*, made from nickel, respectively vapor deposited on the other surface. The thickness of the PVDF film and electrode layers is exaggerated for clarity of illustration.

Typically the negative electrodes 54*a* and 54*b* of the film sensors are directly in contact with the conductive ledge 40 of the beam 36 to provide a ground for the sensors. Conversely, if desired, the positive electrodes 52*a* and 52*b* of the film could be positioned directly in contact with the conductive ledge 40. The only difference is that the polarity of the voltage coming from the sensors 50*a* and 50*b* would be reversed.

In a preferred embodiment, a printed circuit board (PCB) 56 is positioned across the first sensor 50*a* and the second sensor 50*b*. The PCB 56 has two positive electrical contact pads (electrodes) 58*a* and 58*b* located on each end and a negative contact pad (electrode) 58*c* in the center. In the assembled pickup assembly 30, the positive contact pads 58*a* and 58*b* are centered over the positive electrodes 52*a* and 52*b* of each sensor 50*a* and 50*b*. The positive contact pads 58*a* and 58*b* are connected together in parallel and routed to the lead of a braided (shielded) co-axial cable 60 which is attached to the PCB 56. The bottom portion of lead, which has one end connected to the PCB and the other end exiting out through the cap 66, is surrounded by a strain relief sleeve 62 which is made from heat shrink material. The negative contact pad in the center of the PCB contacts the ledge 40 of the beam 36 which is a ground plane and the braid from the cable 60 is connected to the negative contact pad. Alternatively, the co-axial cable 60 may contain two separate leads attached to the PCB 56. By attaching one lead to positive contact pad 58*a* and attaching the other lead to positive contact pad 58*b* and then connecting each lead to a separate pre-amplifier, stereo sound is created.

In a preferred embodiment, the contact pads are formed of a copper foil and are adhesively bonded to the PCB. Subsequently, the copper foil is electroplated with a layer of nickel followed by a layer of gold. A recess 64, which is formed in the top surface of the beam at its center, provides a space to accommodate the top portion of the cable 60 that is attached to and extends below the beam 36.

Alternatively, the PVDF film 53 can be directly adhered to the contact pads 58*a* and 58*b* of the PCB 56 and to the beam 36 eliminating the need for a separate layer of positive electrodes 52*a* and 52*b* and negative electrodes 54*a* and 54*b* on the film. By attaching the top surface of the film 53 directly to the positive surface of the contact pads 58*a* and 58*b* and by attaching the bottom surface of the film directly to the ledge 40, a positive electrode is formed on one side of the piezoelectric film 53 and a negative electrode is formed on the other side.

Figure 8:
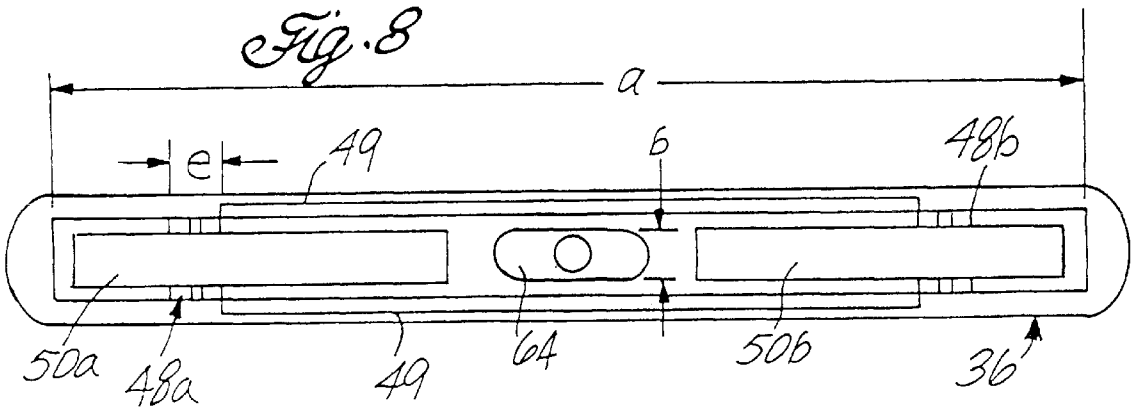
FIG. 8 is a semi-schematic top view of the beam of FIG. 7*a* showing dimensions.

A cap 66 is mounted on top of the beam 36. As is shown in FIG. 4, the cap 66 has grooves 65 disposed axially on opposing sides on its bottom interior surface. Referring to FIG. 8 in addition to FIG. 4, the beam has ridges 49 disposed axially along opposing sides adjacent its top surface 38. The grooves 65 in the cap snap over the ridges 49 of the beam 36 to insure the cap 66 fits properly over the beam. If the cap is made from a non-conductive material, the underside of the cap 66 is coated with a conductive material and, when snapped in place, makes contact with the coated surface of the beam 36 which acts as a ground plane. Because the underside of the cap contacts the beam, a complete shield, or ground plane, is formed around the sensors.

In a preferred embodiment the cap 66 is also made of an acrylonitrile-butadiene styrene (ABS) plastic material with 2.5% carbon and 10% stainless steel fibers incorporated therein to provide conductivity. If desired, however, the cap 66 can also be made from other suitable plastic materials, or from wood, such as spruce and maple or from a metal, such as aluminum or zinc. It is not necessary for the beam 36 and cap 66 to be made from the same materials. For example, the beam 36 can be made from an electrically conductive material while the cap 66 can be made from a non-electrically conductive material that is coated with a conductive material.

If the material used for the cap 66 is non-conductive, the inside surface 66*a* of the cap, as well as the bottom portion 66*b* that comes into contact with the beam, is coated with a conductive material to also provide a ground plane and a shield against RF interference.

The cap is permanently secured to the center portion 43*c* of the beam by applying a small dab of adhesive such as either epoxy or cynaoacrylate near the grooves 65 and the ridges 49 of the beam 36 prior to snapping the cap in place. When the cap is in place, the left 38*a* and right 38*c* portions of top'surface of the beam 38 are located approximately 0.015 inches below the center portion 38*c* of the top surface of the beam 38. This allows the cap to completely encase the sensors, along with top surface of the beam 38 while not hindering the movement of the sensors.

In a preferred embodiment, elastomeric pads 68 are mounted on top of the PCB 56 and the cap is positioned over the elastomeric pads and snapped into place on the beam. The dimensions of the components of the pickup are such that when fully assembled the elastomeric pads are compressed between the cap and the beam thereby exerting a spring force, of about 6–10 psi, which presses the PCB 56 against the sensors 50*a* and 50*b*. The spring force causes the PCB positive contact pads 58*a* and 58*b* and the positive electrodes 52*a* and 52*b* of the PVDF film sensor as well as the negative PCB contact pad 58*c* and the ledge 40 to be in secure electrical contact. Note that it is not necessary to use elastomeric pads, other devices such as spring assemblies or the like can provide the spring force.

In addition to providing a spring force on the PCB 56, the elastomeric pads 68 provide additional damping of the pickup assembly 30 to inhibit ringing from resonances. In an exemplary embodiment, the pads 68 are made from Poron Cellular Urethane manufactured by Rogers Corp. of Rogers, Conn.

Vibrations transmitted to the components of the stringed instrument via the strings 24 cause the ends 43*a* and 43*b* of the beam 36 to move relative to the beam center portion 43*c* via the hinge sections 46*a* and 46*b*. As the ends 43*a* and 43*b* of the beam move, the hinges 46*a* and 46*b* allow the walls of the gaps to move toward and away from each other in synchronization with the vibrations.

The ends 43*a* and 43*b* of the beam 36 requires tuning or adjusting to attain a desired resonant frequency, that is the frequency at which the beam ends vibrate most efficiently. When sensed frequencies are below the resonant frequency of the beam ends, the beam ends act as mechanical high-pass filters and begin to reject vibrational energy. For example, if the resonant frequency of the beam ends is 200 cycles, frequencies below 200 cycles are attenuated.

The material of the beam 36 and the thickness of the hinges 46*a* and 46*b* determines the resonant frequency of the beam ends. Thus, to tune the beam ends to a desired resonant frequency, the hinge thickness is adjusted. The desired thickness of the hinge is a function of the stiffness of the material from which the beam is fabricated. One approach for determining the desired hinge thickness is to first determine the resonant frequency of the beam ends. This can be done, for example, by using a 12 inch loudspeaker with the speaker cone removed therefrom. A flat strip of material, is then stretched across the speaker opening and-the speaker's voice coil is attached to the strip so the speaker magnet assembly will energize the strip. The pickup assembly 30 provided in accordance with practice of the present invention is secured to the material strip with the adhesive pad 44. Preferably the strip is made from a material that has a resonant frequency that is several octaves below the resonant frequency of the beam ends. In a preferred embodiment, the strip is made from styrene or ABS plastic that is about 0.125 inches thick. After the pickup assembly and material strip are in place, an amplifier and frequency sine wave generator are used to sweep a frequency spectrum across the pickup with the sine wave frequency being from about 1000 cycles to about 50 cycles. The output of the pickup assembly is connected to an oscilloscope while the constant amplitude signal is applied to the strip. The resonant frequency of the beam ends is where the output of the pickup begins to diverge from the signal being applied to the strip. If the resonant frequency of the beam ends is higher than desired, the hinges 46*a* and 46*b* are made thinner and if the resonant frequency is lower than desired, the hinges 46*a* and 46*b* are made thicker. The test to determine the resonant frequency is then repeated until a pickup comprising a beam with a hinge thickness appropriate to provide the desired resonant frequency of the beam ends is obtained.

Movement of the beam ends 43*a* and 43*b* cause the gaps formed by the slits 42*a* and 42*b* to change dimension in the X direction in synchronization with the vibrations. The vibrations are caused by plucking the strings 18 of the guitar 10, which applies a stress to the sensors when the gaps vibrate. As a result, the sensor mounted across each gap moves or flexes producing an electrical signal, i.e., a voltage, which is proportional to the stress. The amplitude of the electrical signal varying directly with the applied stress. The positive PCB contact pads 58*a* and 58*b* are directly connected to the sensors 50*a* and 50*b* via the sensor electrodes and transmit the electrical signal produced by the sensors to the wire 60 which is connected to an amplifier.

In an alternative embodiment, the lead from the cable 60 is directly attached to the positive electrodes of the sensors and the shield of the cable 60 is directly connected to the ledge 40. By directly attaching the cable lead to the sensors, the electrical signal is transmitted directly from the sensors to the lead of the cable 60, thus eliminating the need for the PCB and the elastomeric pads.

A pickup assembly comprising sensors which are placed across gaps (slits) which are transverse to the X-axis of the guitar, such as the pickup assembly 30 of the present invention, results in the assembly sensing and responding to vibrations that are mainly in the X-axis direction. Such a pickup assembly is substantially completely insensitive to vibrations in the Y-axis and only detects a negligible amount of vibration in the Z-axis. Because the pickup assembly 30 of the present invention senses modulation across the narrow gaps or slits 42*a* and 42*b*, the point of greatest sensitivity to the vibrations is very accurately focused. Additionally because the sensors are spaced from the vibrating guitar surface by the height of the beam 36, the motion of the V-shaped sections 48*a* and 48*b* of the opening of the top portions of the gaps or slits 42*a* and 42*b* at the sensor location is a greater than the motion of the slits near the hinges. As a result the sensitivity of the sensors is increased.

Turning to FIG. 6, in addition to FIG. 5, there is shown a semi-schematic fragmentary side view of the first slit 42*a* in the beam portion 36 of the pickup assembly 30. Preferably, the sensors 50*a* (shown in FIG. 6) and 50*b* are attached to the beam 36 so that there is a slight bend or pucker 70 extending into the V-shaped section 48*a* at the top of the slits when the sensors are in a relaxed state. The sensors 50*a* and 50*b*, due to their elevation from the guitar top, do not directly interact with the vibrating surface of the musical instrument, unlike a surface mounted pickup assembly. The pucker 70 of each of the sensors is completely relaxed and responds linearly to the modulation of the gap produced by the guitar body and string vibrations. The electrical signal produced by the portion of the sensors which incorporate the pucker is significantly larger than the signal produced by the end portions of the sensors which are directly attached to the beam 36.

In a preferred embodiment, a damping material 74 fills the space between the bottom of the V-shaped sections 48 at the top of the slits 42 and the sensors 50. The damping material contacts the bottom surface of the sensors and acts as a shock absorber to damp the self-resonances of the sensor material. Preferably the damping material has a sufficiently high melting temperature so the material will not run or ooze into the instrument under conditions to which the instrument is expected to be subjected. In a preferred embodiment, the damping material 30 is comprised of silicone which has a melting temperature of approximately 200° C., a temperature that is higher than that to which a guitar is expected to be subjected. Silicone Heat Sink Compound manufacture by Tech Lube and distributed by Techchem of Welland, Ontario, Canada can be used as the damping material.

In one embodiment, the pickup assembly 30 incorporates structure to accommodate a second pickup assembly which has been previously mounted in the stringed instrument. Referring to FIGS. 7*a* and 7*b*, the beam 36 has a L-shaped cavity 72 that extends through one of its ends, for example, the end 43*b*. When a pickup assembly 30 provided in accordance with practice of the present invention is mounted on top of the previously mounted pickup assembly, the wire of the previously mounted pickup assembly can be routed from beneath the assembly 30 through the L-shaped cavity 72 and then to a pre-amplifier.

Figure 7C:
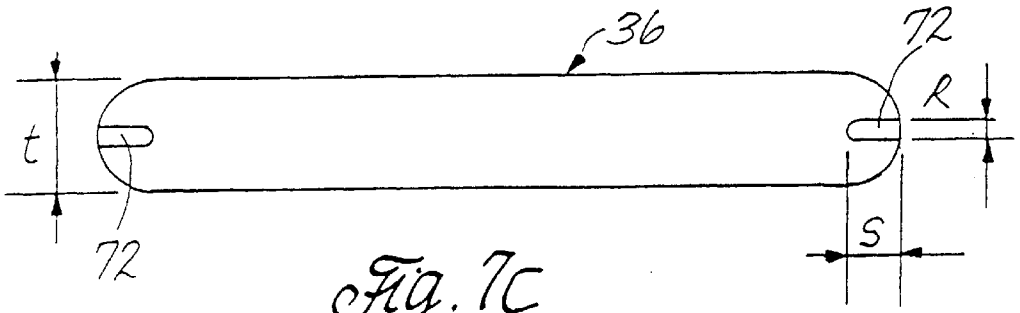
FIG. 7*c* is a semi-schematic bottom view of the beam of FIG. 7*a* showing dimensions.

Turning to FIGS. 7*c* and 8 in addition to FIGS. 7*a* and 7B, one example of the pickup assembly beam 36 provided in accordance with the present invention for use in a guitar is shown with its dimensions identified. In this embodiment, the beam is injection molded from a 2.5% carbon and 10% stainless steel fiber filled ABS plastic. Turning first to FIG. 7*a*, the width (v) of each of the slits 42*a* and 42*b* is 0.040 inches and the thickness (z) of each hinge 46*a* and 46*b* is 0.09 inches. The width, (e), of the widest part of the V-shaped section 48*a* and 48*b* in each slit is 0.136 inches and the distances (j and l) from the center of the slits 42*a* and 42*b* to the ends of the beam 36 are 0.47 inches. The distance (k) from the center of the first slit 42*a* to the center of the second slit 42*b* is 1.935 inches. The length (m) of the beam 36 is 2.875 inches, the height (d) of the beam 36 is 0.395 inches, the length (g) of the recess 64 is 0.41 inches and the distance (f) from the bottom of the recess 64 to the top surface 38 of the beam is 0.1 inches. The height (i) of the cavity 72 in the beam is 0.25 inches.

Turning now to FIG. 7*b*, the width (q) of the beam 36 is 0.425 inches, the height (o) of the beam is 0.425 inches and the thickness (p) of the center portion of the beam is 0.165 inches. The width (n) of the beam ledge 40 is 0.225 inches and the height (w) of the base of the beam is 0.090 inches.

Turning now to FIG. 7*c*, the width (t) of the bottom surface of the beam (t) is 0.425 inches, the length (s) of the cavity 72 in the bottom surface of the beam is 0.2 inches and the width (R) of the cavity 72 is 0.078 inches.

Turning now to FIG. 8, the length (a) of the ledge is 2.645 inches, the width (b) of the recess 64 is 0.15 inches, the width (e) of the widest part of the V-shape portion in the top of the gap is 0.136 inches.

Referring to FIGS. 1 and 4, the pickup assembly 30 provided in accordance with the present invention can be mounted on the guitar 10 through the sound hole 14 using a mounting device (not shown). First, the string retaining posts 28 are removed which releases the strings 24 allowing easy access to the underside of the sound board 18. The mounting device comprises a rectangular plate with pins located in each end of the device that extend through both sides of the plate. The device is initially placed on the outer surface of the guitar with the pins placed in the outermost holes left by the removal of the string retaining posts 28. When in place, the plate extends over the bridge 20 of the guitar 10.

The pickup assembly 30 is then mounted upside down onto the plate of the mounting device directly above the bridge 20. Then the mounting device is removed from the top of the guitar 10 and is placed inside the guitar 10 through the sound hole 14. With the pickup assembly 30 facing towards the bridge plate 32 on the underside of the sound board 18, the pins in the mounting device are again placed in the outermost holes left by the removal of the string retaining posts 28. The device is forced toward the surface of the bridge plate 32 until the adhesive 44 on the bottom of the pickup assembly 30 comes into contact with the bridge plate 32. Once the pickup assembly 30 is secured to the bridge plate 32, the device is removed and the pickup assembly 30 is left in place. The lead from the cable 60 extends through a hole 13, as shown in FIG. 1, in the end of the guitar 10 and is connected to a pre-amplifier (not shown). In an alternative embodiment, a pre-amplifier can be directly mounted on the PCB inside of the pickup using field effect transistors (FETs).

Figure 9:
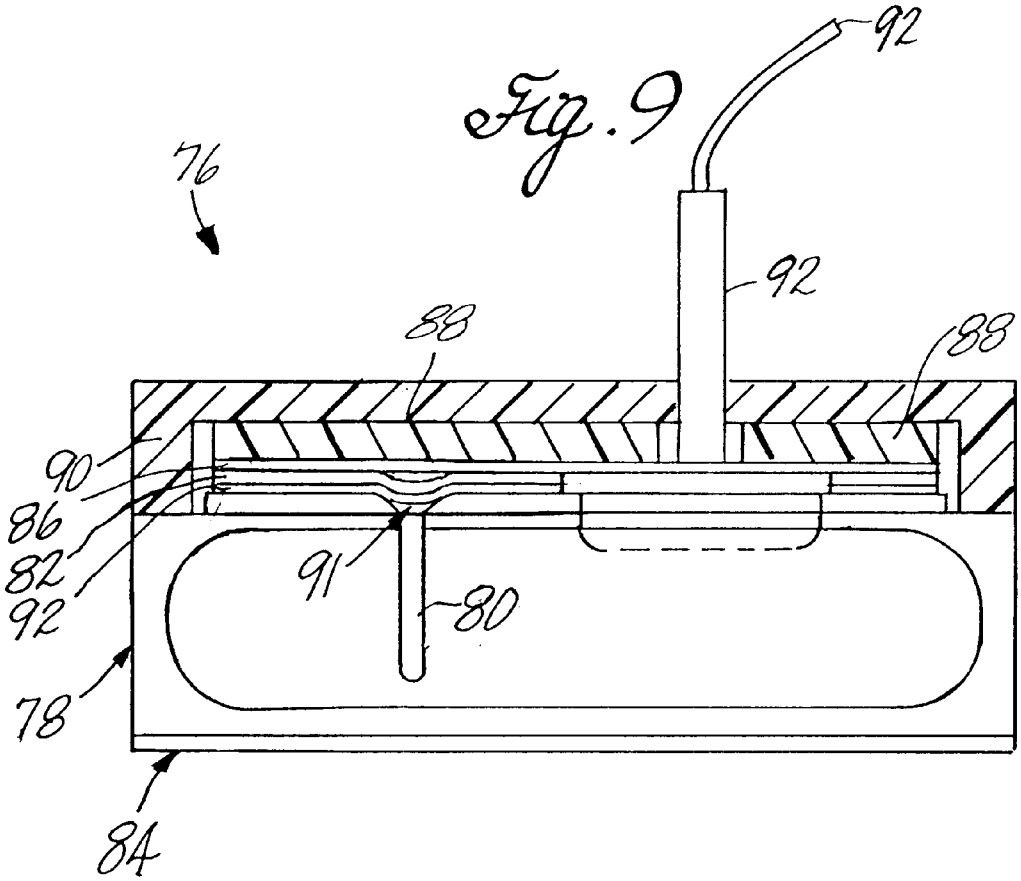
FIG. 9 is a semi-schematic side view in partial cross section of a second exemplary embodiment of a pickup assembly provided in accordance with practice of the present invention.

Turning to FIG. 9, a semi-schematic side view in partial cross section of another exemplary embodiment of a pickup assembly 76 provided in accordance with the present invention is shown. The pickup assembly 76 comprises a beam 78 with a single slit 80, and with a V-shaped section 91, formed therein. A sensor 82 is adhered to the beam 78 with a foam adhesive 92, a PCB 86, elastomeric pads 86, a cap 90, a lead 92 and a strain relief sleeve 94. The elements of the single slit embodiment of the pickup assembly 76 are formed from the same materials and function in the same manner as the elements of the pickup assembly 30 of the embodiment of FIGS. 2–8.

In alternative embodiments, sensors such as, Hall Effect sensors, magnetic coils, strain gauges, and piezo crystal sensors can be used instead of the above described PVDF film sensor. Unlike the PVDF film sensor, the magnetic sensors, and piezo crystal sensors are not placed across the slits. When the magnetic sensors are used, magnets are placed on one side of the gap defining each slit and a coil of wire is placed around the magnet. A metal plate made of a magnetically sensitive material, such as steel, is placed on the opposite wall in proximity to the coil, one side of the coil being positive and the other side being negative. As the surface of the stringed instrument vibrates, the gap changes in dimensions in synchronization with the vibrations. As the gap narrows and widens, the magnet and coil move toward and away from the metal plate which induces a voltage response. This voltage represents the vibrations in the X-axis direction and is sent via a lead to a pre-amplifier.

With regard to the piezo crystal sensor, an insulated piezo crystal is placed into the top each gap. One side of the crystal has a positive electrode and one side has a negative electrode. As the gap moves in response to vibrations of the instrument, the crystal is compressed and released in response to the movement of the gap. As a result, the crystal produces an electrical signal that is sent through the wire to an amplifier.

In another embodiment, a strain gauge is utilized instead of the PVDF film sensor. With a strain gauge, an electrical material, that changes resistance in response to variations in stress, covers the first slit and second slit measuring the movement of the gaps in the slits. A current is sent through the material. As the material expands and contracts, the resistance of the material is decreased and increased which in turn modulates the current in response to the change in stress. This produces an electrical signal that is transmitted to the wire through the PCB which in turn is transmitted to an pre-amplifier.

It will be appreciated that the pickup assemblies for stringed instruments provided in accordance with practice of the present invention may be utilized in a wide variety of different types of stringed instruments, such as guitars, mandolins, ukeleles, banjos, bases, fiddles, violins, and the like. If desired, the pickup assembly may also be utilized on a piano sound board and for wind, drums and other musical instruments. While the pickup assembly of the present invention is described above as having a structure in the shape of an elongated beam in which the sensors are mounted, structures having shapes such as a cube or the like can be used.

The above descriptions of exemplary embodiments of the pickup assembly provided in accordance with practice of the present invention are for illustrative purposes. Because of variations which will be apparent to those skilled in the art, the present invention is not intended to be limited to the particular embodiments described above. The scope of the invention is defined in the following claims.

What is claimed is:

1. A pickup assembly for a stringed musical instrument, the pickup assembly comprising:

a structure having, a top, a bottom and first and second ends;

said structure having at least one slit, wherein each such slit is through the top surface of said structure at an angle generally perpendicular to the axis along the length of said structure;

at least one sensor is positioned across each such slit, wherein each such sensor produces an electrical signal in response to a change in dimension of the gap which defines the slit, wherein said gap dimension changes in response to vibrations; and an electrical cable having at least one lead in electrical contact with each such sensor, wherein an electrical signal from the sensor is transmitted to said lead.

2. The pickup assembly as recited in claim 1, wherein said structure is formed from an electrically conductive material or includes an electrically conductive surface and said cable has a shield in electrical contact with said structure or with said electrically conductive surface.

3. The pickup assembly as recited in claim 1, wherein the top of said gap comprises a V-shape.

4. The pickup assembly as recited in claim 3, wherein a damping material is in the V-shape portion of said gap.

5. The pickup assembly as recited in claim 4, wherein the damping material comprises silicone.

6. The pickup assembly as recited in claim 3, wherein said sensor is depressed into the V-shape portion of said gap.

7. The pickup assembly as recited in claim 1, wherein said sensor produces the electrical signal substantially in response to a change in the dimension of the gap in the X-axis direction.

8. The pickup assembly as recited in claim 1, wherein said sensor comprises a PVDF film.

9. The pickup assembly as recited in claim 1, wherein said structure comprises an elongated beam.

10. The pickup assembly as recited in claim 8, wherein said film has a first side and a second side and wherein a positive electrode is adhered on the first side of said film and a negative electrode is adhered on the second side of said film.

11. The pickup assembly as recited in claim 1, which comprises a hinge having a thickness dimension extending from the bottom of said slit to the bottom surface of said structure.

12. The pickup assembly as recited in claim 1, wherein said structure is formed from a material selected from a group consisting of wood, plastic and metal.

13. The pickup assembly as recited in claim 1, wherein the structure is formed from an electrically conductive material providing a ground plane for each such sensor.

14. The pickup assembly as recited in claim 1, wherein the structure is formed from an electrically non-conductive material and the top surface of said structure is coated with a conductive material providing a ground plane for each sensor.

15. The pickup assembly as recited in claim 1, wherein the stringed musical instrument comprises a sound board.

16. The pickup assembly as recited in claim 15, wherein the pickup assembly is mounted on the inside surface of the sound board.

17. The pickup assembly as recited in claim 15, wherein the pickup assembly is mounted on the outside surface of the sound board.

18. The pickup assembly as recited in claim 1, wherein each such sensor is attached to said structure with a conductive adhesive.

19. The pickup assembly as recited in claim 1, wherein each such sensor is capacitively coupled to said structure.

20. The pickup assembly as recited in claim 1, wherein each such lead is directly connected to each such sensor.

21. The pickup assembly as recited in claim 1, wherein said pickup assembly further comprises a circuit board overlaying each such sensor and wherein said circuit board comprises a pair of position electrical contact pads with each such lead being electrically connected to at least one of said contact pads.

22. The pickup assembly as recited in claim 21, further comprising elastomeric pads on top of said circuit board, wherein said elastomeric pads provide a spring force that urges said circuit board toward said sensor to maintain electrical contact between each such contact pad and the associated sensor.

23. The pickup assembly as recited in claim 22, wherein said assembly comprises a cap mounted on said structure wherein each such elastomeric pad is compressed between the inside surface of the cap and said circuit board.

24. The pickup assembly as recited in claim 23, wherein said cap is formed from an electrically conductive material.

25. The pickup assembly as recited in claim 23, wherein said cap is formed from an electrically non-conductive material and the inside and bottom surfaces of said cap is coated with a conductive material.

26. The pickup assembly as recited in claim 24, wherein said structure is formed from an electrically conductive material.

27. The pickup assembly as recited in claim 24, wherein said structure is formed from an electrically non-conductive material and the top surface of said structure is coated with a conductive material providing a ground plane for each sensor.

28. The pickup assembly as recited in claim 25, wherein said structure is formed from an electrically conductive material.

29. The pickup assembly as recited in claim 25, wherein said structure is formed from an electrically non-conductive material and the top surface of said structure is coated with a conductive material providing a ground plane for each sensor.

30. The pickup assembly as recited in claim 1, wherein said structure contains at least one L-shaped cavity.

31. The pickup assembly as recited in claim 23, wherein said circuit board contains a pre-amplifier.

32. A stringed instrument comprising:

an instrument body;

a sound board;

a bridge;

a pickup assembly disposed upon the sound board, the pickup assembly comprising:

a structure having a top, a bottom and first and second ends;

said structure comprising at least one slit, wherein each slit is through the top surface of said structure at an angle generally perpendicular to the axis along the length of said structure;

at least one sensor is positioned across each such slit, wherein each such sensor produces an electrical signal in response to a change in dimension of the gap which defines the slit, wherein said gap dimension changes in response to vibrations; and an electrical cable having at least one lead in electrical contact with each such sensor, wherein an electrical signal from the sensor is transmitted to said lead.

33. The stringed instrument as recited in claim 32, wherein said structure is formed from an electrically conductive material or includes an electrically conductive surface and said cable has a shield in electrical contact with said structure or with said electrically conductive surface.

34. The stringed instrument as recited in claim 32, wherein the top of said gap comprises a V-shape.

35. The stringed instrument as recited in claim 34, wherein a damping material is in the V-shape portion of said gap.

36. The stringed instrument as recited in claim 35, wherein the damping material comprises silicone.

37. The stringed instrument as recited in claim 34, wherein said sensor is depressed into the V-shape portion of said gap.

38. The stringed instrument as recited in claim 32, wherein said sensor produces the electrical signal substantially in response to a change in the dimension of the gap in the X-axis direction.

39. The stringed instrument as recited in claim 32, wherein said sensor comprises PVDF film.

40. The stringed instrument as recited in claim 32, wherein said structure comprises an elongated beam.

41. The pickup assembly as recited in claim 39, wherein said film has a first side and a second side and wherein a positive electrode is on the first side of said film and a negative electrode is on a second side of said film.

42. The stringed instrument as recited in claim 32, wherein the pickup assembly comprises a hinge having a thickness dimension extending from the bottom of said slit to the bottom surface of the structure.

43. The stringed instrument as recited in claim 32, wherein said structure is formed from a material selected from a group consisting of wood, plastic and metal.

44. The stringed instrument as recited in claim 42, wherein said structure is formed from an electrically conductive material providing a ground plane for each such sensor.

45. The stringed instrument as recited in claim 32, wherein the structure is formed from an electrically non-conductive material and the top surface of said structure is coated with a conductive material providing a ground plane for each sensor.

46. The stringed instrument as recited in claim 45, wherein said pickup assembly is mounted on the inside surface of the sound board.

47. The stringed instrument as recited in claim 45, wherein said pickup assembly is mounted on the outside surface of the sound board.

48. The stringed instrument as recited in claim 32, wherein each such sensor is attached to said with a conductive adhesive.

49. The pickup assembly as recited in claim 32, wherein each such sensor is capacitively coupled to said structure.

50. The stringed instrument as recited in claim 32, wherein said pickup assembly further comprises a circuit board overlying each such sensor and wherein said circuit board comprises a pair of positive electrical contact pads with each such lead being electrically connected to at least one of said contact pads.

51. The stringed instrument as recited in claim 50, further comprising elastomeric pads on top of said circuit board, wherein said elastomeric pads provide a spring force that urges said circuit board toward said sensor to maintain electrical contact between each such contact pad and the associated sensor.

52. The pickup assembly as recited in claim 51, wherein said circuit board contains a pre-amplifier.

53. The stringed instrument as recited in claim 51, wherein said assembly comprises a cap mounted on said structure wherein each such elastomeric pad is compressed between the inside surface of the cap and said circuit board.

54. The stringed instrument as recited in claim 53, wherein said cap is formed from an electrically conductive material.

55. The pickup assembly as recited in claim 53, wherein said cap is formed from an electrically non-conductive material and the inside and bottom surfaces of said cap is coated with a conductive material.

56. The pickup assembly as recited in claim 54, wherein said structure is formed from an electrically conductive material.

57. The pickup assembly as recited in claim 54 wherein said structure is formed from an electrically non-conductive material and the top surface of said structure is coated with a conductive material providing a ground plane for each sensor.

58. The pickup assembly as recited in claim 55, wherein said structure is formed from an electrically conductive material.

59. The pickup assembly as recited in claim 55, wherein said structure is formed from an electrically non-conductive material and the top surface of said structure is coated with a conductive material providing a ground plane for each sensor.

60. The stringed instrument as recited in claim 32, wherein said structure contains at least one L-shaped cavity.

61. A pickup assembly for a stringed musical instrument, the pickup assembly comprising:

a structure having, a top, a bottom and first and second ends;

first and second slits at opposing ends of said structure wherein, said slits are through the top surface of said structure at an angle generally perpendicular to the axis along the length of said structure;

a first sensor positioned across the first slit and a second sensor positioned across the second slit, each of said sensors producing an electrical signal in response to a change in dimension of the gap defining the slit, said gap dimension changing in response to vibrations; and an electrical cable having at least one lead in electrical contact with the first sensor and a second lead in electrical contact with the second sensor, wherein an electrical signal from the sensor is transmitted to said lead.

62. The stringed instrument as recited in claim 61, wherein said structure is formed from an electrically conductive material or includes an electrically conductive surface and said cable has a shield in electrical contact with said structure or with said electrically conductive surface.

63. The pickup assembly as recited in claim 61, wherein the top of said gap comprises a V-shape.

64. The pickup assembly as recited in claim 63, wherein a damping material is in the V-shape portion of said gap.

65. The pickup assembly as recited in claim 64, wherein the damping material comprises silicone.

66. The pickup assembly as recited in claim 61, wherein each of said sensors are depressed into the V-shape portion of said gap.

67. The pickup assembly as recited in claim 61, wherein each of said sensors produces an electrical signal substantially in response to a change in the dimension of the gap in the X-axis direction.

68. The pickup assembly as recited in claim 61, wherein each of said sensors consists of a PVDF film.

69. The pickup assembly as recited in claim 61, wherein said structure comprises an elongated beam.

70. The pickup assembly as recited in claim 68, wherein said film has a first side and a second side and wherein a positive electrode is adhered on the first side of said film and a negative electrode is adhered on the second side of said film.

71. The pickup assembly as recited in claim 61, comprising a first hinge and a second hinge having a thickness dimension extending from the bottom of said slits to the bottom surface of said structure.

72. The pickup assembly as recited in claim 61, wherein said structure is formed from a material selected from a group consisting of wood, plastic and metal.

73. The stringed instrument as recited in claim 61, wherein said structure is formed from an electrically conductive material.

74. The pickup assembly as recited in claim 61, wherein the structure is formed from an electrically non-conductive material and the top surface of said structure is coated with a conductive material providing a ground plane for each of said sensors.

75. The pickup assembly as recited in claim 61, wherein said pickup assembly is mounted on the inside surface of the musical instrument.

76. The pickup assembly as recited in claim 61, wherein said pickup assembly is mounted on the outside surface of the musical instrument.

77. The pickup assembly as recited in claim 61, wherein each of said sensors is attached to said structure with a conductive adhesive.

78. The pickup assembly as recited in claim 61, wherein each of said sensors is capacitively coupled to said structure.

79. The pickup assembly as recited in claim 61, wherein said pickup assembly further comprises a circuit board and each lead is connected to a first contact pad and a second contact pad on said circuit board.

80. The pickup assembly as recited in claim 61, wherein said pickup assembly further comprises a circuit board overlaying said sensors and wherein said circuit board comprises a pair of positive electrical contact pads with each such lead being electrically connected to at least one of said contact pads.

81. The pickup assembly as recited in claim 80, wherein a first elastomeric pad and a second elastomeric pad, on top of said circuit board, provide a spring force that urges the said circuit board toward said sensors to maintain electrical contact between the contact pads and the sensors.

82. The pickup assembly as recited in claim 81, wherein said circuit board contains a pre-amplifier.

83. The pickup assembly as recited in claim 81, wherein the assembly comprises a cap mounted on said structure wherein said elastomeric pads are compressed between the inside surface of the cap and said circuit board.

84. The stringed instrument as recited in claim 83, wherein said cap is formed from an electrically conductive material.

85. The pickup assembly as recited in claim 83, wherein said cap is formed from an electrically non-conductive material and the inside and bottom surfaces of said cap is coated with a conductive material.

86. The pickup assembly as recited in claim 84, wherein said structure is formed from an electrically conductive material.

87. The pickup assembly as recited in claim 84, wherein said structure is formed from an electrically non-conductive material and the top surface of said structure is coated with a conductive material providing a ground plane for each sensor.

88. The pickup assembly as recited in claim 85, wherein said structure is formed from an electrically conductive material.

89. The pickup assembly as recited in claim 85, wherein said structure is formed from an electrically non-conductive material and the top surface of said structure is coated with a conductive material providing a ground plane for each-sensor.

90. The pickup assembly as recited in claim 61, wherein said structure contains first and second L-shaped cavities at opposing ends of said structure.

* * * * *